US006942521B1

(12) United States Patent
Jatou et al.

(10) Patent No.: US 6,942,521 B1
(45) Date of Patent: Sep. 13, 2005

(54) VGA CONNECTOR WITH INTEGRAL FILTER

(75) Inventors: Ross F. Jatou, San Jose, CA (US); Charlie J. Shu, San Ramon, CA (US)

(73) Assignee: NVIDIA Corporation, Santa Clara, CA (US)

( * ) Notice: Subject to any disclaimer, the term of this patent is extended or adjusted under 35 U.S.C. 154(b) by 0 days.

(21) Appl. No.: 10/914,892

(22) Filed: Aug. 10, 2004

(51) Int. Cl.[7] ..... H01R 13/648
(52) U.S. Cl. ..... 439/607
(58) Field of Search ..... 439/607, 620, 439/79; 361/760, 783, 600; 702/127

(56) References Cited

U.S. PATENT DOCUMENTS 4,789,847 A * 12/1988 Sakamoto et al. ..... 333/185
5,108,300 A * 4/1992 Weber ..... 439/188
5,344,342 A * 9/1994 Briones ..... 439/620
5,547,398 A * 8/1996 Ichikawa et al. ..... 439/607
5,605,473 A * 2/1997 Kishon ..... 439/502
5,709,556 A * 1/1998 Tan et al. ..... 439/79
5,711,678 A * 1/1998 Wu ..... 439/79
5,736,910 A * 4/1998 Townsend et al. ..... 333/181
5,774,342 A * 6/1998 Brandenburg et al. ..... 361/774
5,832,420 A * 11/1998 Yuhara et al. ..... 702/127
6,022,245 A * 2/2000 Minich ..... 439/620
6,068,509 A * 5/2000 Lin ..... 439/541.5
6,193,560 B1 * 2/2001 Morana et al. ..... 439/676
6,211,457 B1 * 4/2001 Cama et al. ..... 174/35 C
6,264,504 B1 * 7/2001 Wu ..... 439/607
6,454,603 B2 * 9/2002 Casey et al. ..... 439/607
6,663,432 B2 * 12/2003 Inagawa ..... 439/610
6,711,638 B1 * 3/2004 Wu ..... 710/72
6,723,917 B1 * 4/2004 Wang ..... 174/35 GC

* cited by examiner

*Primary Examiner*—Ross Gushi
*Assistant Examiner*—Larisa Tsukerman
(74) *Attorney, Agent, or Firm*—Moser Patterson & Sheridan LLP

(57) ABSTRACT

An improved VGA connector that supports enhanced graphic performance by internally incorporating one or more functions of fusing, filtering, shielding, and the controlling of signal line impendances. The improved VGA connector is dimensionally interchangeable with many aspects of standard VGA connectors, and use standard pin-outs that mate with mating connectors. Integral DACs can be included to provide analog outputs.

17 Claims, 3 Drawing Sheets

VGA CONNECTOR WITH INTEGRAL FILTER

FIELD OF THE INVENTION

The present invention relates to computer connectors. More specifically, embodiments of the present invention relate to VGA connectors that have integral electronic components.

BACKGROUND OF THE INVENTION

Almost all personal computers use the same type of 15 pin display connector. Because that connector was used in the original IBM VGA card it is often referred to simply as the VGA connector. Since the VGA connector is so widely used it acts as a standard that enables different graphic display electronics providers to provide equipment that mate with displays from different display providers.

While the VGA connector has been very successful over the years, it has several drawbacks that have become more important as displays and the computer systems that drive them have advanced. First, the VGA connector is not particularly well suited for high resolution video graphics systems. This is because the VGA connector does not provide well defined and controlled impedance characteristics.

Yet another problem with VGA connectors is that video graphics systems that use VGA connectors typically require extensive filtering of the signals passed via the VGA connector pins. While this is not in itself a problem, since different suppliers use filters that have different performance characteristics, the "standard" provided by the VGA connector is eroded by widely varying electronic interfaces. Even if two suppliers use supposedly identical filters, one supplier may use higher quality components that provide high quality filtering while the other supplier might use lesser quality components that provide relatively poor filtering. Another problem is that the VGA signals required shielding, but the standard VGA connector does not provide effective signal shielding.

Still another problem with using VGA connectors is that they do not support controlled signal paths. For example, two different display card manufacturers might use different signal paths to traverse the distance between the video driver, typically a digital to analog converter (DAC), and the VGA connector.

Uncontrolled variations in impedance characteristics, signal shielding, signal path lengths, and VGA signal filters can be highly damaging to the quality reputations of major device suppliers. For example, many different manufacturers might supply video graphics cards that use graphical processor devices supplied by another company. Indeed, that company's name is often prominently displayed in connection with the card. Since poor VGA connectors, filters, and uncontrolled signal path lengths can provide noticeably poor performance, the reputation of device suppliers can be harmed by factors related to VGA connectors.

Therefore, an improved VGA connector would be beneficial. Even more beneficial would be an improved VGA connector that provides signal shielding. Also beneficial would be an improved VGA connector that provides internal electronics, such as electronic filters and digital to analog converters. Such VGA connectors that also support controlled analog signal path lengths would also be beneficial.

SUMMARY OF THE INVENTION

The principles of the present invention provide for an improved VGA connector. Embodiments of the principles of the present invention provide for VGA connector having enhanced graphic performance by internally incorporating one or more functions of fusing, filtering, shielding, and controlling of signal line impendances. Embodiments of the inventive VGA connector are dimensionally interchangeable with many aspects of standard VGA connectors, and use standard pin-outs that mate with mating connectors. At least some embodiments include integral DACs to provide analog outputs.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION OF THE PREFERRED EMBODIMENT

The principles of the present invention provide for improved graphic performance using an inventive VGA connector having internal support for one or more fusing, filtering, shielding, and controlling impendances. While the inventive VGA connector is beneficial in many respects, it is in many respects dimensionally interchangeable with standard VGA connectors and pin-outs, and mates with mating connectors. At least some embodiments include integral DACs to provide analog outputs.

For convenience, the standard VGA pinouts are provided below. Because of the pin-outs are standardized, what follows does not discuss particular pins. Rather, what follows discusses pins and connections in relation to power, logic signals, and analog voltages.

Pin 1 Red output
Pin 2 Green out
Pin 3 Blue out
Pin 4 Monitor ID 2 in
Pin 5 Ground
Pin 6 Red return
Pin 7 Green return
Pin 8 Blue return
Pin 9 no pin
Pin 10 Sync return Pin 11 Monitor ID 0 in
Pin 12 Monitor ID 1 in
Pin 13 Horizontal Sync out
Pin 14 Vertical Sync out
Pin 15 reserved (monitor ID 3)

Some of the pins pass analog 0.7 voltages (Vp-p) at nominal 75 ohm loads, while others operate at TTL levels.

Figure 1:
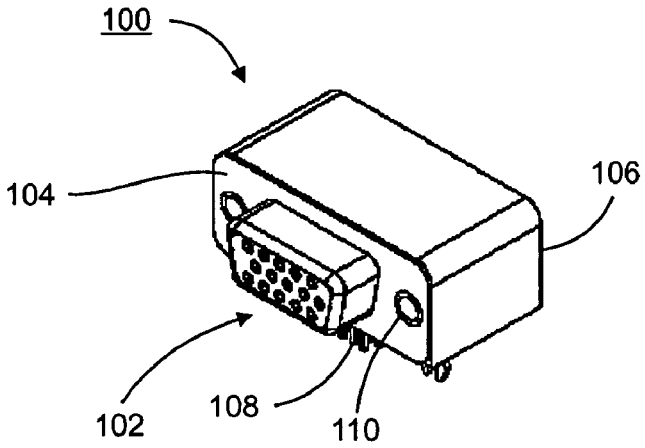
FIG. 1 is a perspective illustration of a VGA connector that is in accord with the principles of the present invention.
Figure 2:
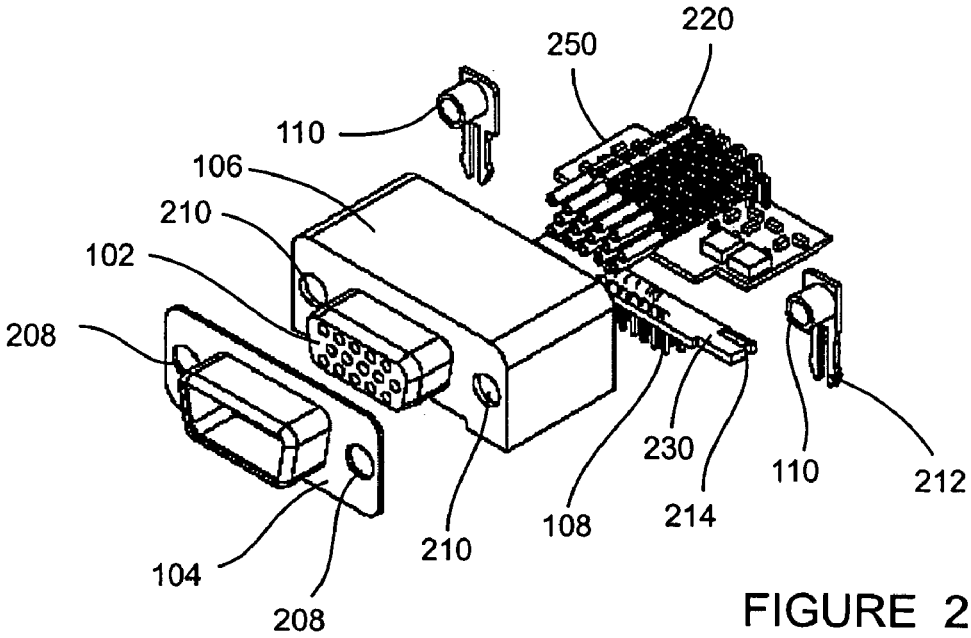
FIG. 2 is an exploded view of the VGA connector illustrated in FIG. 1.

FIG. 1 illustrates a perspective view of a VGA connector 100 that is in accord with the principles of the present invention. The VGA connector 100 includes a pin-retaining molded assembly 102 that extends from a surrounding conductive shield. The assembly 102 is partially covered by and extends into a conductive shroud 104 that mates with the conductive shield 106. The assembly 102 and its relation to the conductive shroud 104 is best shown in FIG. 2. The VGA connector includes pins 108 for mounting on a circuit board. The VGA connector 100 also includes screw threads 110 for receiving a mating male connector's retaining screws. The shield 106 and the shroud 104 provide electrostatic shielding and physical protection for the various components within the VGA connector 100. It should be noted that the pattern of the pins 108, the locations and dimensions of the screw threads, and the physical dimensions and locations of the assembly 102 and the shroud 104 are the same as similar structures found in "standard" VGA connectors. Thus, the VGA connector 100 will mate with standard VGA male connectors.

FIG. 2 is an exploded view of the VGA connector 100. As shown, the shroud 104 includes holes 208 that align with apertures 210 in the shield 106. The screw threads 110 are part of a forked body 212 and, when the VGA connector is assembled, align with the apertures 210 and the holes 208. The forked body 212 extends through slots 214 of a pin holder 230 that retains the pins 108. The forked body 212 is dimensioned and located to match similar features in standard VGA connectors. When mounted on a circuit board the forked body 212 aligns with circuit board mounting holes.

Referring now to FIGS. 1 and 2, extending into the assembly 102 are 15 female pins 220 that each has an elongated body that is bent at 90 degrees. The pins extend from the assembly 102 to a circuit board 250. The circuit board 250 includes a plurality of electronic components that form electronic filters for the pins and, in some embodiments, include digital-to-analog converters (discussed subsequently). The circuit board 250 also connects to the pins 108. While the foregoing has described a circuit board 250, in practice any type of interconnect scheme can be used.

As previously noted, the VGA connector 100 is physically dimensioned in accord to the standard VGA connector such that it mates to a standard VGA male connector. However, the VGA connector 100 includes a non-standard circuit board 250, elongated and bent female pins 220, the protective shield 106, and various electronic components that are discussed below.

Figure 3:
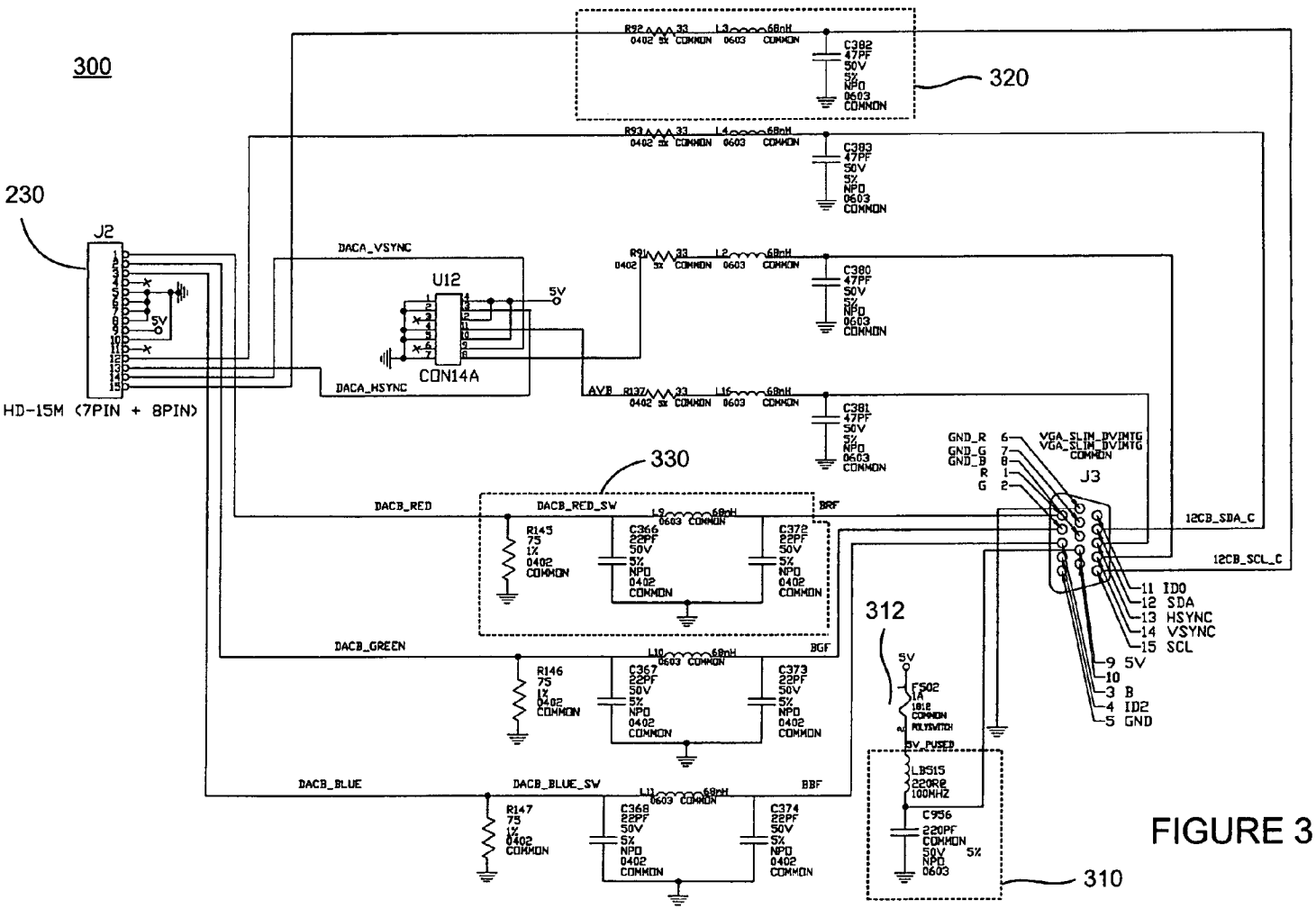
FIG. 3 is a schematic depiction of a filter assembly that is internal to the VGA connector illustrated in FIGS. 1 and 2.

FIG. 3 illustrates a schematic diagram of a filter assembly 300 that is mounted on the circuit board 250. The purpose of the filter assembly 300 is to reduce electrical noise and ringing, and to provide controlled impedances for signals that are output from the female pins 220. The filter assembly 300 is comprised of three types of filters. The first filter 310 filters the output power (5V). It includes an inductor and a capacitor that connect to 5 volts through a fuse 312. The second type of filter 320 is used to filter logic signals. That filter is comprised of a small resistor in series with an inductor, and a capacitor to ground. That filter reduces ringing on the logic lines. The third type of filter 330 filters the red, green and blue outputs which drive the external monitor. Each of those outputs is typically produced by a digital to analog converter (DAC). The filters 330 are comprised of capacitive input pi-filter in parallel with a load resistor. Because of the relatively small size of the VGA connector 100, the various electronic components are comprised of surface mounted devices.

Figure 4:
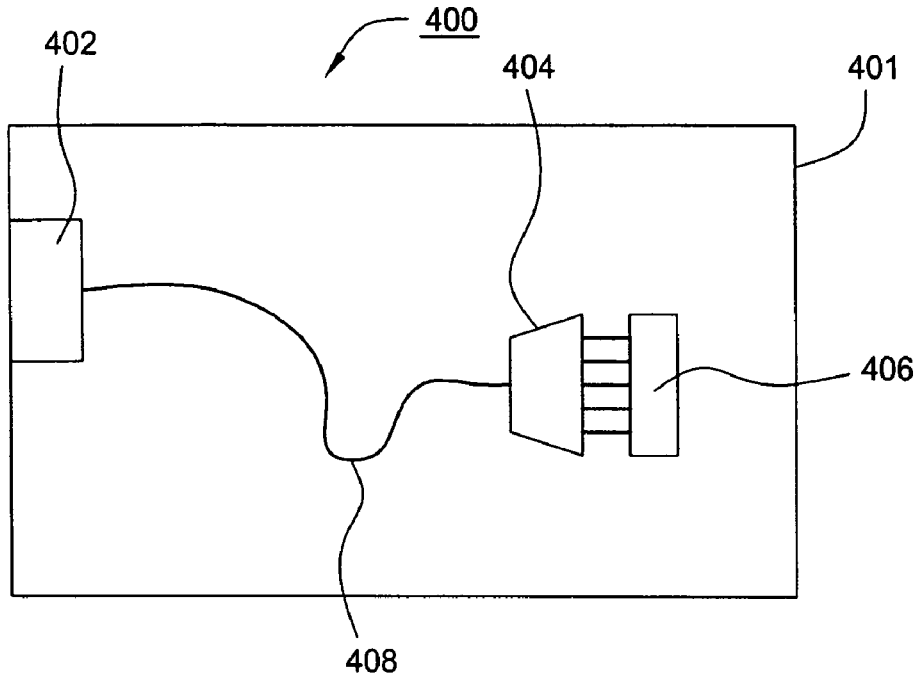
FIGURE 4 (PRIOR ART)
FIG. 4 is schematic depiction of a prior art DAC graphics driver and VGA connector on a circuit board.

While most, possibly all, applications will benefit by having filters within the VGA connector 100, in some applications it may be beneficial to mount the digital-to-analog converters which produce the red, blue and green outputs within the VGA connector 100. One reason to do this is to equalize and/or reduce the signal path lengths of the analog signals, and thus improve performance. For example, FIG. 4 illustrates a generic prior art layout 400 for producing analog color signals. The prior art system 100 includes a prior art VGA connector 402 and a digital analog converter 404 that are both mounted on a graphics card 401. The digital-to-analog converter 404 receives its digital input from a digital driver 406. The digital-to-analog converter 404 sends its output on a line 408 that runs to the VGA connector 402, and from there, to a video monitor. The length of the line 408 is not standardized. Furthermore, since three different digital-to-analog converters 404, one for each color, are required, three different lengths 408 can exist on the same graphics card 401. It is beneficial to reduce the length of the lines 408 and/or to equalize them.

Figure 5:
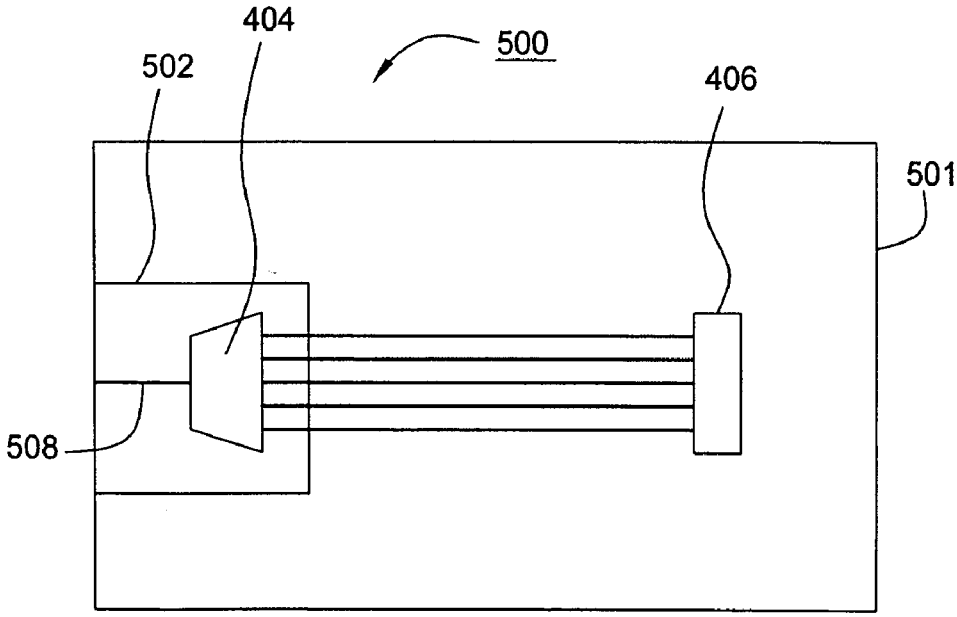
FIG. 5 is a schematic depiction of a VGA connector having an integral DAC driver on a board that feeds digital signals to the DAC.

FIG. 5 illustrates a graphics layout 500 that is in accord with the principles of the present invention. That layout 500 includes a printed circuit board 501 and a VGA connector 502, which is very similar to the VGA connector 100 except the VGA connector 502 includes at least one (preferably all) digital-to-analog converters 404 on the circuit board 250. The output of the digital-to-analog converter 404 is on a line 508, which can be very short. Furthermore, the digital signals from the digital driver 406, which are not particularly susceptible to noise, can be routed across the board 501 at the convenience of the circuit board layout engineer.

While the foregoing is directed to embodiments of the present invention, other and further embodiments of the invention may be devised without departing from the basic scope thereof, and the scope thereof is determined by the claims that follow.

We claim:

1. A video graphics connector, comprising:

a plurality of elongated pins;

a pin retaining structure for retaining the elongated pins;

a conductive shroud;

a conductive shield;

an interconnect scheme internal to the video graphics connector and a plurality of connector pins, wherein the interconnect scheme provides electrical connections between the plurality of elongated pins and the plurality of connector pins; and at least one filter and at least one digital to analog converter within the shroud for providing signals output over the plurality of elongated pins;

wherein the conductive shroud and the conductive conducive shield provide electrostatic shielding, and wherein the video graphic connector is dimensioned to mate with standard video graphics mating connectors.

2. The video graphics connector of claim 1, wherein the interconnect scheme includes a fused power line filter for fusing and filtering output power.

3. The video graphics connector of claim 1, wherein the interconnect scheme includes an analog signal filter for filtering an analog output.

4. The video graphics connector of claim 1, wherein the interconnect scheme includes a logic filter for filtering a logic signal.

5. The video graphics connector of claim 1, wherein the interconnect scheme includes a digital to analog converter for providing an analog output over the plurality of elongated pins and the plurality of connector pins.

6. A video graphics connector, comprising:

a shield forming an interior space;

a molded assembly that extends from said shield, said molded assembly having elongated female pins, each having a bend within said interior space;

a shroud that extends over portions of said molded assembly that extend past said shield, the shroud and the shield providing electrostatic shielding;

a plurality of board connectors that extend from said shield; and an interconnect scheme in said interior space, said interconnect scheme for providing electrical connections between a plurality of said female connectors and said board connectors said interconnect scheme including a digital to analog converter within the shroud for providing an analog output over the plurality of female connectors.

7. The video graphics connector of claim 6, further including a forked screw thread structure have screw threads that are located in said interior space;

wherein said shield and said shroud include screw openings that align with said screw threads;

wherein said forked screw thread structure partially extends out of said shield to enable attachment to an external structure; and wherein the video graphic connector is dimensioned to mate with standard video graphics mating connectors.

8. The video graphics connector of claim 6, wherein said interconnect scheme filter includes a fused power line filter for fusing and filtering output power.

9. The video graphics connector of claim 6, wherein said interconnect scheme filter includes an analog signal filter for filtering an analog output.

10. The video graphics connector of claim 6, wherein said interconnect scheme filter includes a logic filter for filtering a logic signal.

11. A video graphics card assembly, comprising:

a graphics card;

a logic device on said graphics card, said logic device for providing logic signals; and a VGA connector on said graphics card, said VGA connector comprising:

a shield forming an interior space;

a molded assembly that extends from said shield, said molded assembly having a plurality of elongated female pins, each having a bend within said interior space;

a shroud that extends over portions of said molded assembly that extend from said shield;

a plurality of board connectors that extend through said shield;

an interconnect scheme in said interior space, said interconnect scheme for providing electrical connections between a plurality of said female connectors and said board connectors; and a digital to analog converter on said interconnect scheme;

wherein said logic signals operatively pass from said logic device, through at least one connector of said plurality of board connectors, to said digital to analog converter; and wherein said digital to analog converter converts said logic signals into an analog voltage that is applied to one of the elongated female pins.

12. The video graphics card assembly of claim 11, wherein said shroud and said shield provide electrostatic shielding.

13. The video graphics card assembly of claim 11, wherein said interconnect scheme includes a fused power line filter for fusing and filtering output power.

14. The video graphics card assembly of claim 11, wherein said interconnect scheme includes an analog signal filter for filtering an analog output.

15. The video graphics card assembly of claim 11, wherein said interconnect scheme includes a logic filter for filtering the logic signal.

16. The video graphics card assembly of claim 11, further including a forked screw thread structure have screw threads that are located in said interior space;

wherein said shield and said shroud include screw openings that align with said screw threads;

wherein said forked screw thread structure partially extends out of said shield and attaches said VGA connector to said graphics card; and wherein the VGA connector is dimensioned to mate with standard video graphics mating connectors.

17. The video graphics card assembly of claim 11 further including a plurality of digital to analog converters in said interconnect scheme, signals converted by said digital to analog converters being applied to the pins.

* * * * *

UNITED STATES PATENT AND TRADEMARK OFFICE

CERTIFICATE OF CORRECTION

PATENT NO. : 6,942,521 B1
DATED : September 13, 2005
INVENTOR(S) : Jatou et al.

It is certified that error appears in the above-identified patent and that said Letters Patent is hereby corrected as shown below:

Column 4,
Line 57, replace “;” with -- , --.

Column 5,
Line 27, replace “have” with -- having --.
Line 28, replace “;” with -- : --.

Column 6,
Line 36, replace “have” with -- having --.
Line 37, replace “;” with -- : --.

Signed and Sealed this

Tenth Day of January, 2006

JON W. DUDAS
*Director of the United States Patent and Trademark Office*